United States Patent [19]

Hull

[11] 4,437,598

[45] Mar. 20, 1984

[54] BELT BUCKLE

[76] Inventor: Evan B. Hull, 49 Pleasant St., Northboro, Mass. 01532

[21] Appl. No.: 365,036

[22] Filed: Apr. 2, 1982

[51] Int. Cl.[3] ..... A45C 1/04

[52] U.S. Cl. ..... 224/163; 224/229; 24/163 K

[58] Field of Search ..... 224/163, 229, 166; 24/3 F, 163 K

[56] References Cited

U.S. PATENT DOCUMENTS

| | | | |
|---|---|---|---|
| 931,823 | 8/1909 | Waugh | 224/163 X |
| 1,508,963 | 9/1924 | Dorf | 224/163 |
| 1,599,920 | 9/1926 | Pryor | 224/163 |
| 2,678,723 | 5/1954 | Tilson | 224/163 X |
| 2,836,351 | 5/1958 | Epstein | 224/163 X |
| 4,068,787 | 1/1978 | Craighead | 224/163 |

FOREIGN PATENT DOCUMENTS

| | | | |
|---|---|---|---|
| 683040 | 2/1930 | France | 224/163 |
| 1515451 | 6/1978 | United Kingdom | 224/163 |

*Primary Examiner*—Steven M. Pollard

*Attorney, Agent, or Firm*—Blodgett & Blodgett

[57] ABSTRACT

A functioning belt buckle with a hidden compartment for money and valuable papers, wherein the belt acts as a closure for the compartment.

6 Claims, 8 Drawing Figures

BELT BUCKLE

BACKGROUND OF THE INVENTION

The activities of the thief and the pickpocket are certainly not new phenomena, but there appears to be a significant increase in street crime in America recently. More and more citizens are experiencing the loss of money and other valuable papers and concomitant inconveniences resulting from either overt robbery by threat of violence, or by unnoticed theft from their very pockets. To prevent such losses it is common to carry all or part of one's money in an unusual location, especially a location not susceptible to unobtrusive access by another, or to quick discovery by an assailant. Among such locations have been: hidden pockets, hollow shoe heels, zippered money belts, secret pockets in a wallet or purse, etc.

Unfortunately, secreting one's money in any one of these locations, while reducing the possibility of discovery by another, also reduces one's own convenient access. In some cases, clothing must be removed or opened to retrieve money. Also, hidden pockets, money belts, and the like tend to reveal themselves by unusual shapes or protuberances. Zippered money belts can become still less accessible by the sticking or jamming of their closures. These and other difficulties experienced with the prior art devices and methods have been obviated in a novel manner by the present invention.

It is, therefore, an outstanding object of the invention to provide a compartmentalized element which can be worn as clothing and which can be used for carrying valuables.

Another object of this invention is the provision of a wearable compartment whose contents are conveniently accessible to the owner.

A further object of the present invention is the provision of a wearable compartment, which is not readily accessible to unauthorized persons.

It is another object of the instant invention to provide a wearable compartment which effectively disguises its purpose, thereby frustrating overt theft of its contents.

A still further object of the invention is the provision of a wearable compartment with no moving parts which might stick or malfunction.

It is a further object of the invention to provide a wearable compartment which holds money and valuable papers securely, yet releases them easily at the will of the owner.

Another object of the invention is the provision of a wearable compartment which conceals its contents even when the device is taken off.

Another object of the invention is the provision of a wearable compartment which does not reveal its presence by bulging or distorting when used.

Another object of the invention is the provision of a wearable compartment which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a functional belt buckle of conventional appearance, having a compartment on its inner surface adapted to securely hold and hide currency and other valuable papers and so arranged as to allow easy access to the compartment's contents by the wearer.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
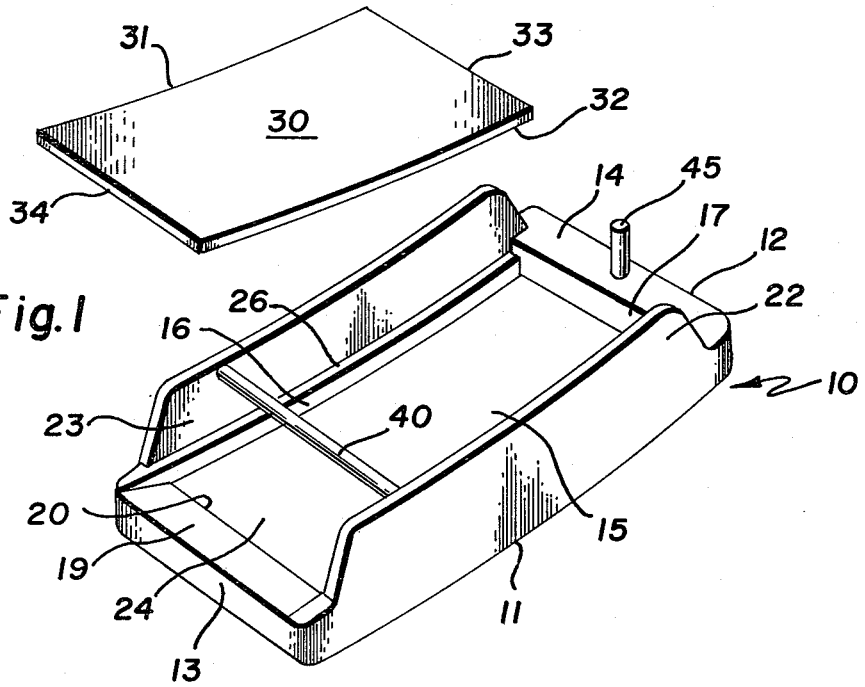
FIG. 1 is a perspective view of a belt buckle embodying the principles of the present invention, partly exploded to show important inner features.

Referring first to FIG. 1, wherein are best shown the general features of the invention, the belt buckle, indicated generally by the reference numeral 10, is shown as having a main body 11 with a first end 12, a second end 13, and an inner surface 14. The inner surface encompasses an extensive cavity 15 which is rectangular in outline, the cavity having three square walls 16, 17, and 18 (wall 18 not visible), and a fourth, sloping or beveled wall 19. The beveled wall 19 is squared off in the close neighborhood of the floor of the cavity 15 to form a slight lip 20.

Rising perpendicularly from the inner surface 14 are two flanges 22 and 23 which, together with the inner surface 14, form an open rectangular channel 24. Between flange 23 and one wall 16 of the cavity, a horizontal portion of the inner surface forms a ledge 26. Likewise, between flange 22 and wall 18 is a similarly-formed ledge 27, not visible. (The location of ledges 26 and 27 may be more clearly seen in the sectional view in FIG. 6).

The rectangular plate 30 is of a size and shape to rest with one edge 31 on ledge 26, the opposite edge 32 resting on ledge 27, and a third edge 33 contiguous with wall 17 of the cavity 15. The fourth edge 34 is free and is far enough from the beveled wall 19 to leave an access slot or opening 35, as shown clearly in FIG. 2.

Figure 2:
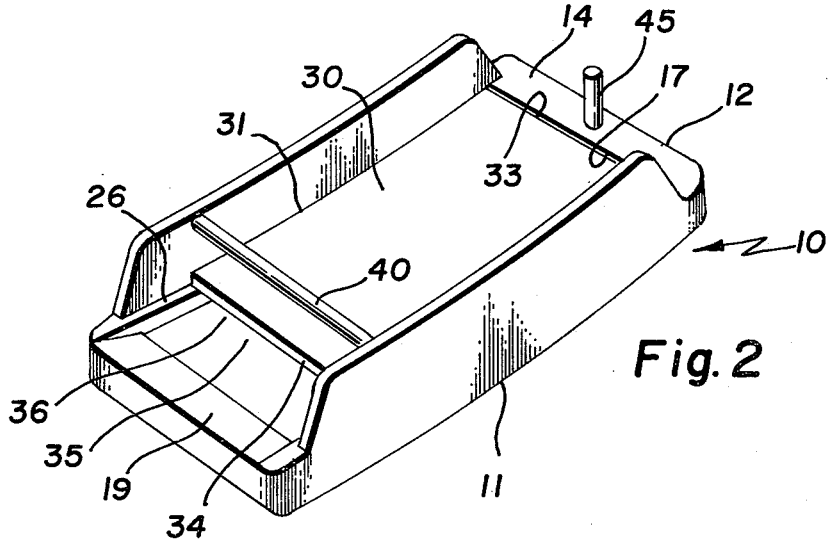
FIG. 2 is a rear perspective view.
Figure 4:
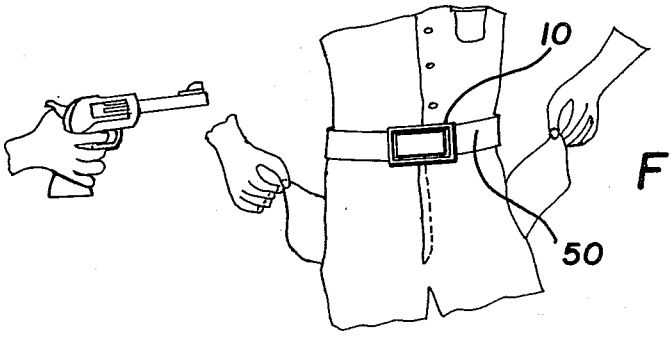
FIG. 4 is a view of the buckle in use.

Also referring to FIG. 2, a spindle 40 extends transversely across the channel 24 and is offset from the longitudinal center of the channel in the direction of the said second end 13 of the main body 11. The spindle may be soldered, welded, or otherwise attached to the flanges 22 and 23.

Similarly, FIG. 2 shows a peg 45, rising from the inner surface 14 of the main body 11 near the said first end in a direction normal to the surface 14. In the preferred embodiment, this peg consists of a flat-headed rivet, the head of which is held in the mold used to cast the device so as to become an integral part of the main body.

Figure 3:
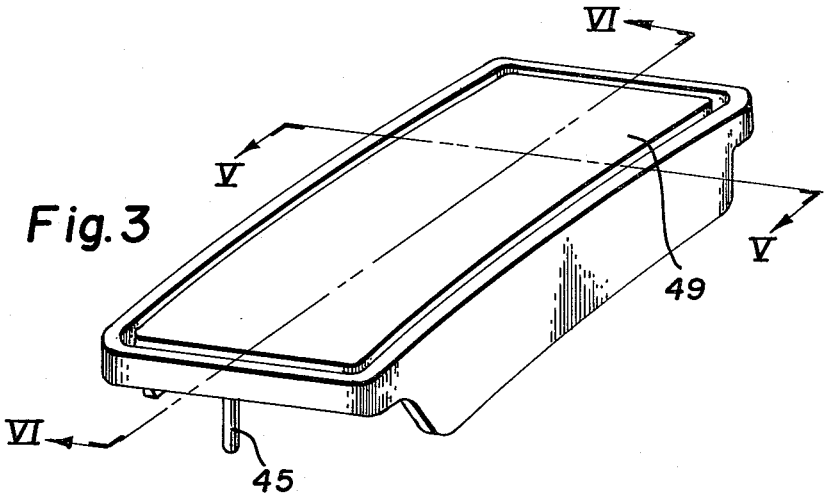
FIG. 3 is a front perspective view.

As FIG. 3 shows, the buckle has an outer surface 49 which may be shaped and aesthetically designed to suit different tastes and fashions.

Figure 5:
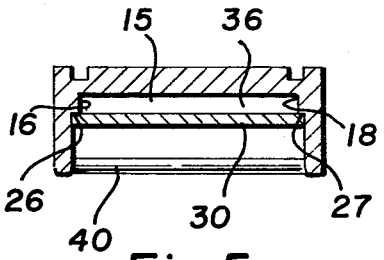
FIG. 5 is a sectional view of the buckle taken on line V—V of FIG. 3.
Figure 6:
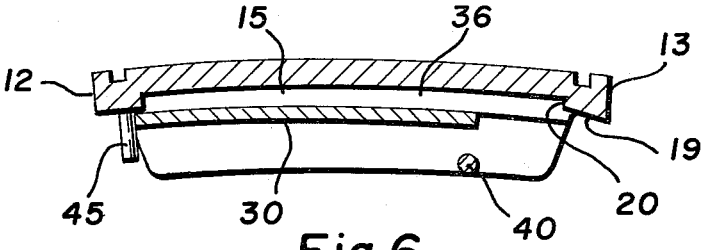
FIG. 6 is a sectional view of the buckle taken on line VI—VI of FIG. 3.

FIGS. 5 and 6 most clearly show the shape and dimensions of the compartment 36. FIG. 6 particularly indicates the concentric curvature of the plate 30 and the floor of the cavity 15 which gives the cavity itself a curved shape. Without the plate 30 and the spindle 40, it is apparent that the buckle in this embodiment is completely drawable in the sense used in the molding art. Therefore, its manufacture has an economically advantageous simplicity. The main body 11, with its cavity 15 and flanges 22 and 23, is molded in one step. Optionally, the peg 45 may be integrally molded into the main body at the same time or provided afterwards. The plate 30 may then easily be fastened in its place over the cavity 15 by soldering or the like. Similarly, the spindle may be easily attached in its place between the flanges, thus defining a space with the plate, the space being approximately twice the thickness of the belt which will be combined with the buckle.

Figure 7:
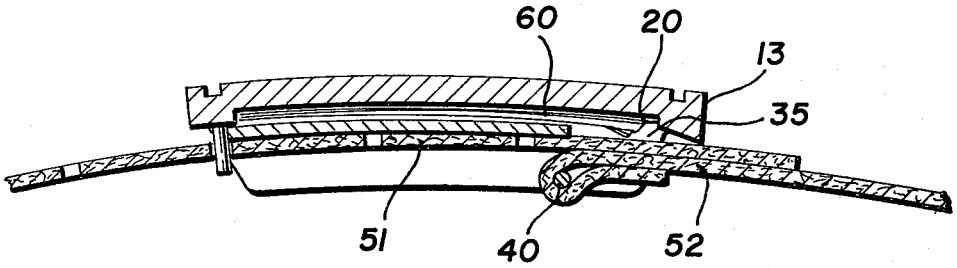
FIG. 7 is a sectional view as in FIG. 6, showing the buckle being used with a belt, the compartment being in a closed position.
Figure 8:
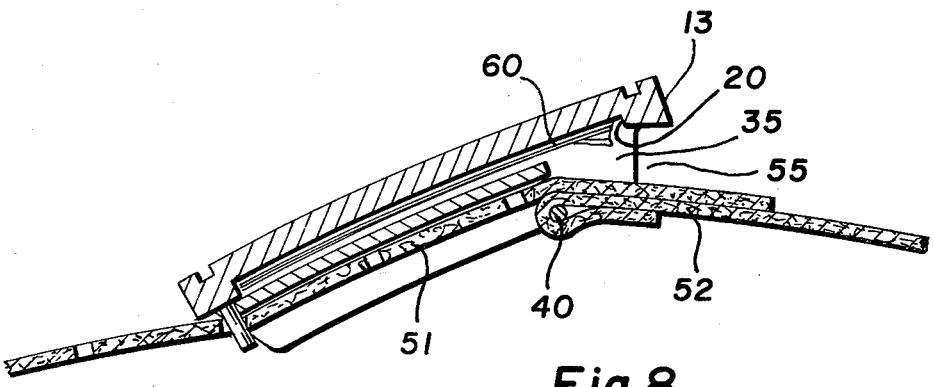
FIG. 8 is a sectional view as in FIG. 7, but with the compartment shown in an open position.

The use and operation of the invention will now be readily understood in view of the above description. Referring to FIGS. 7 and 8, one end 52 of a belt 50 will normally be attached in a relatively permanent manner to the spindle 40, using snaps or rivets. The belt is placed around the user's waist in the usual way and the other end 51, (which has holes arranged at intervals) is slipped into the remaining space between the spindle and plate. The belt will be tightened and fastened as desired by inserting the peg 45 into a chosen hole in the belt.

As the belt is worn, pressure on the offset spindle 40 by the belt tends to press the respective end 13 of the main body toward the belt, leaving no space and concealing the access opening 35 of the compartment 36. However, by either removing the belt or by grasping the buckle near the said second end 13 and pulling outward, a gap 55 may be opened, allowing materials 60 to be inserted or removed from the compartment.

The slight curvature of the compartment has the affect of pressing materials that are resilient, like paper money, in several spots to hold such materials securely, but releasably. In particular, there is a tendency for the edge of the materials near the access opening to be pressed into the lip 20, thus further securing them. The materials can be removed by the user by pulling them away from the lip and drawing them out of the compartment against the frictional resistance.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

I claim:

1. Buckle for use with a belt comprising:

(a) a main body portion having a front end, a back end, and a generally planar outer wall with an inner surface, (b) a back wall extending inwardly from said inner surface at said back end, (c) a pair of side walls extending inwardly from said inner surface at opposite sides of said main body portion between said front and back ends, (d) a generally planar inner wall fixed to said back and side walls and spaced from said inner surface to define a compartment with said inner surface, back and side walls, said compartment having an opening at said front end for receiving currency and other valuable papers for storage in said compartment, (e) a front wall extending inwardly from said inner surface at said front end, said front wall being substantially spaced from said opening, (f) first attaching means for releasably securing one end of a belt to said back end, and (g) second attaching means for more permanently securing the other end of the belt to said front end so that when the belt is attached to said first attaching means in its normal wearing position around a person's waist, a portion of the belt extends from said opening to said front wall to conceal and cover said opening.

2. Buckle as recited in claim 1, wherein said front wall has an inner surface which extends at an obtuse angle with respect to the inner surface of said outer wall to allow material to be smoothly inserted into and removed from said compartment.

3. Buckle as recited in claim 1, wherein the inner limits of said front wall, back wall and inner wall lie within the same general plane and said side walls extend inwardly beyond said plane to define a channel for the belt.

4. Buckle as recited in claim 3, wherein said second attaching means is a spindle which extends across said channel between said side walls and which is spaced from said inner wall.

5. Buckle as recited in claim 4, wherein said spindle is located adjacent said opening and between said opening and said back end.

6. Buckle as recited in claim 1, wherein said first attaching means is a peg extending inwardly from said back wall.

* * * * *